US005689424A

United States Patent [19]

Arsenault et al.

[11] Patent Number: 5,689,424

[45] Date of Patent: Nov. 18, 1997

[54] ENCODED SCREEN RECORDS FOR INTERNATIONAL POSTAGE METERS

[75] Inventors: Robert G. Arsenault, Stratford; William F. Bailey, Guilford; Dale A. French, Clinton, all of Conn.

[73] Assignee: Pitney Bowes Inc., Stamford, Conn.

[21] Appl. No.: 702,079

[22] Filed: Aug. 23, 1996

[51] Int. Cl.[6] ..... G07B 17/00

[52] U.S. Cl. ..... 364/464.21; 395/788

[58] Field of Search ..... 364/400, 464.11, 364/464.2, 464.21; 395/200.14, 784, 785, 788

[56] References Cited

U.S. PATENT DOCUMENTS

| | | | |
|---|---|---|---|
| 3,956,615 | 5/1976 | Anderson | 235/61 |
| 4,280,060 | 7/1981 | Kure-Jensen et al. | 364/494 X |
| 4,837,797 | 6/1989 | Freeny et al. | 379/96 |
| 4,905,156 | 2/1990 | Vermesse | 364/464.21 |
| 4,914,606 | 4/1990 | Vermesse | 364/464.11 |
| 4,918,601 | 4/1990 | Vermesse | 364/464.21 |
| 4,928,249 | 5/1990 | Vermesse | 364/464.21 X |
| 5,009,276 | 4/1991 | Raikes et al. | 177/25.15 |
| 5,111,030 | 5/1992 | Brasington | 235/375 |
| 5,165,014 | 11/1992 | Vassar | 395/112 |
| 5,260,900 | 11/1993 | Muller | 365/189.01 |
| 5,280,531 | 1/1994 | Hunter | 382/1 |
| 5,309,363 | 5/1994 | Gaves et al. | 364/464.02 |
| 5,319,854 | 6/1994 | Meinecke et al. | 395/325 |
| 5,509,409 | 4/1996 | Kim et al. | 395/114 |

*Primary Examiner*—Edward R. Cosimano

*Attorney, Agent, or Firm*—Christopher J. Capelli; Robert H. Whisker; Melvin J. Scolnick

[57] ABSTRACT

In a digital postage meter having a housing shell, a display screen mounted in the housing shell, and a removable printhead, a method of transmitting information from the printhead module to the display screen. The method includes: storing the information in a memory device in the printhead module; retrieving the information in a first communication device in the printhead module; transmitting the information from the first communication device to a second communication device external to the printhead module, wherein the second communication device interprets the information; and transmitting the interpreted information to the display screen.

9 Claims, 6 Drawing Sheets

FIG. 5

RECORD #7

| 01 | 00 | 02 | 44 | 41 | 54 | 45 | 20 | 3D | 02 | 01 | 08 | 03 | 01 | 08 | 00 | 06 | 66 |
|---|---|---|---|---|---|---|---|---|---|---|---|---|---|---|---|---|---|

INTERPRETATION

| INSTRUCTION | PARAMETER(S) | |
|---|---|---|
| 01 | 00 | POSITION THE CURSOR AT COORDINATES 0,0 |
| 02 | 44 41 54 45 20 3D 02 | TYPE:DATA = |
| 01 | 08 | POSITION THE CURSOR AT COORDINATES 0,8 |
| 03 | 01 08 00 | INSERT OUTPUT FIELD #01 WITH LENGTH OF 8, LEFT JUSTIFIED |
| 06 | 66 | RETRIEVE ADDITIONAL INFORMATION FROM RECORD #102 |

FIG. 6

RECORD #102

| 01 | 48 | 02 | 4D | 4D | 2F | 44 | 44 | 2F | 59 | 59 | 02 | 05 | 24 | 00 | 01 | 48 | 04 | 01 | 08 | 00 |
|---|---|---|---|---|---|---|---|---|---|---|---|---|---|---|---|---|---|---|---|---|

INTERPRETATION

| INSTRUCTION | PARAMETER(S) | |
|---|---|---|
| 01 | 48 | POSITION CURSOR AT COORDINATES 4,8 |
| 02 | 4D 4D 2F 44 44 2F 59 59 02 | TYPE:MM/DD/YY |
| 01 | 48 | (RE)POSITION CURSOR AT COORDINATES 4,8 |
| 05 | 24 00 | DURING USER ENTRY SKIP OVER THE 3RD AND 6TH CHARACTERS IN THE ENTRY FIELD |
| 04 | 01 08 00 | INSERT ENTRY FIELD #01 WITH LENGTH OF 8, LEFT JUSTIFICATION |

FIG. 7

RESULTING SCREEN:

| | |
|---|---|
| DATE = | 01/30/96 |
| | MM/DD/YY |

43

FIG. 8

EQUIVALENT SCREEN RECORDS IN UNITED KINGDOM PRINT MODULE

RECORD #7

| | | | | | | | | | | | | | | | | | |
|---|---|---|---|---|---|---|---|---|---|---|---|---|---|---|---|---|---|
| 01 | 00 | 02 | 44 | 41 | 54 | 45 | 20 | 3D | 02 | 01 | 08 | 03 | 01 | 08 | 00 | 06 | 66 |

RECORD #102

| | | | | | | | | | | | | | | | | | | | | |
|---|---|---|---|---|---|---|---|---|---|---|---|---|---|---|---|---|---|---|---|---|
| 01 | 48 | 02 | 4D | 4D | 2E | 44 | 44 | 2E | 59 | 59 | 02 | 05 | 24 | 00 | 01 | 48 | 04 | 01 | 08 | 00 |

FIG. 9

EQUIVALENT SCREEN RECORDS IN FRENCH PRINT MODULE

RECORD #7

| | | | | | | | | | | | | | | | | | |
|---|---|---|---|---|---|---|---|---|---|---|---|---|---|---|---|---|---|
| 01 | 00 | 02 | 44 | 41 | 54 | 45 | 20 | 3D | 02 | 01 | 08 | 03 | 01 | 08 | 00 | 06 | 66 |

RECORD #102

| | | | | | | | | | | | | | | | | | | | | |
|---|---|---|---|---|---|---|---|---|---|---|---|---|---|---|---|---|---|---|---|---|
| 01 | 48 | 02 | 41 | 41 | 2F | 4D | 4D | 2F | 4A | 4A | 02 | 05 | 24 | 00 | 01 | 48 | 04 | 01 | 08 | 00 |

FIG. 10

EQUIVALENT SCREEN RECORDS IN JAPANESE PRINT MODULE

RECORD #7

| | | | | | | | | | | | | | | | | | |
|---|---|---|---|---|---|---|---|---|---|---|---|---|---|---|---|---|---|
| 01 | 00 | 02 | CB | BD | DE | B9 | 3D | 02 | 01 | 08 | 03 | 01 | 08 | 00 | 06 | 66 |

RECORD #102

| | | | | | | | | | | | | | | | | | | | | |
|---|---|---|---|---|---|---|---|---|---|---|---|---|---|---|---|---|---|---|---|---|
| 01 | 48 | 02 | 4D | 4D | 2F | 44 | 44 | 2F | 59 | 59 | 02 | 05 | 24 | 00 | 01 | 48 | 04 | 01 | 08 | 00 |

FIG. 11

RESULTING UNITED KINGDOM SCREEN:

| | |
|---|---|
| DATE = | 01.30.96 |
| | MM.DD.YY |

RESULTING FRENCH SCREEN:

| | |
|---|---|
| DATE = | 96/01/30 |
| | AA/MM/JJ |

RESULTING JAPANESE SCREEN:

| | |
|---|---|
| ﾋﾂﾞｹ = | 01/30/96 |
| | MM/DD/YY |

ENCODED SCREEN RECORDS FOR INTERNATIONAL POSTAGE METERS

BACKGROUND OF THE INVENTION

The instant invention relates to postage meters and more particularly to a postage meter having a screen which displays information which is encoded.

Digital postage meters are well known and typically include a display screen which displays relevant information to the user of the meter. The assignee of the instant invention, however, has developed a new, low cost, digital postage meter intended for use by low volume mailers which is characterized by the fact that the only physically secured part of the meter is the printhead circuit board and the vault in the form of a smart card which, in some cases, comprises an insertable smart card. The meter display is controlled by software in a base unit or housing shell and by information received through a serial channel that extends from the base unit. Funds information that passes through the serial channel is protected by encrypted messages, but display information passing through the serial channel is not encrypted, although it is encoded. Display information is transferred from a storage component located in a removable print module. The storage component of the print module can be programmed by serial messages that are not protected by encryption. It is possible for unauthorized personnel to tap into base unit communications and supply display information that is not sourced from the print module's storage component. As noted, the display information is encoded but the codes can easily be deciphered by tapping and examining communications between the base unit and the print module. The aforesaid new meter is also designed to be used in a plurality of countries. Different countries have different requirements for their postage indicias. Heretofore, whenever a meter had to be changed so that it could be used in a different country, the meter manufacturer had to service the meter in a particular, suitable location.

The above-described problems associated with the new, low-cost, digital meter are overcome by the instant invention which provides uniquely formatted, encoded messages for the display information passing through the serial channel. The encoded messages of the instant invention could only be deciphered by reverse engineering which would involve extensive time and effort. The encoded messages are extremely efficient in speed and memory utilization and allow the use of slower microcontrollers and smaller memory components and enable replaceable, country specific print modules to be used so that the same meter can be used for different countries without the manufacturer having to service the meter in a particular, suitable location. The print modules can be replaced in the field.

SUMMARY OF THE INVENTION

Thus, the instant invention provides, in a digital postage meter having a housing shell, a display screen mounted in the housing shell, and a removable printhead, a method of transmitting information from the printhead module to the display screen. The method comprises: storing the information in a memory device in the printhead module; retrieving the information in a first communication device in the printhead module; transmitting the information from the first communication device to a second communication device external to the printhead module, wherein the second communication device interprets the information; and transmitting the interpreted information to the display screen.

BRIEF DESCRIPTION OF THE DRAWINGS

FIG. 5 shows an encoded screen record for a date entry in an indicia for U.S. postage and the interpretation for the record;

FIG. 6 shows an additional, linked record and interpretation for the same date entry as in FIG. 5;

FIG. 7 shows the output on the display screen resulting from the linked screen records shown in FIGS. 5 and 6;

FIG. 8 shows the encoded screen records for the same date entry as shown in FIGS. 5 and 6 except the indicia is for use in the United Kingdom;

FIG. 9 is the same as FIG. 8 except the indicia is for use in France;

FIG. 10 is the same as FIG. 9 except the indicia is for use in Japan;

FIG. 11 shows the resulting screen displays for the screen records shown in FIGS. 8–10.

DETAILED DESCRIPTION OF THE PREFERRED EMBODIMENT

Figure 1:
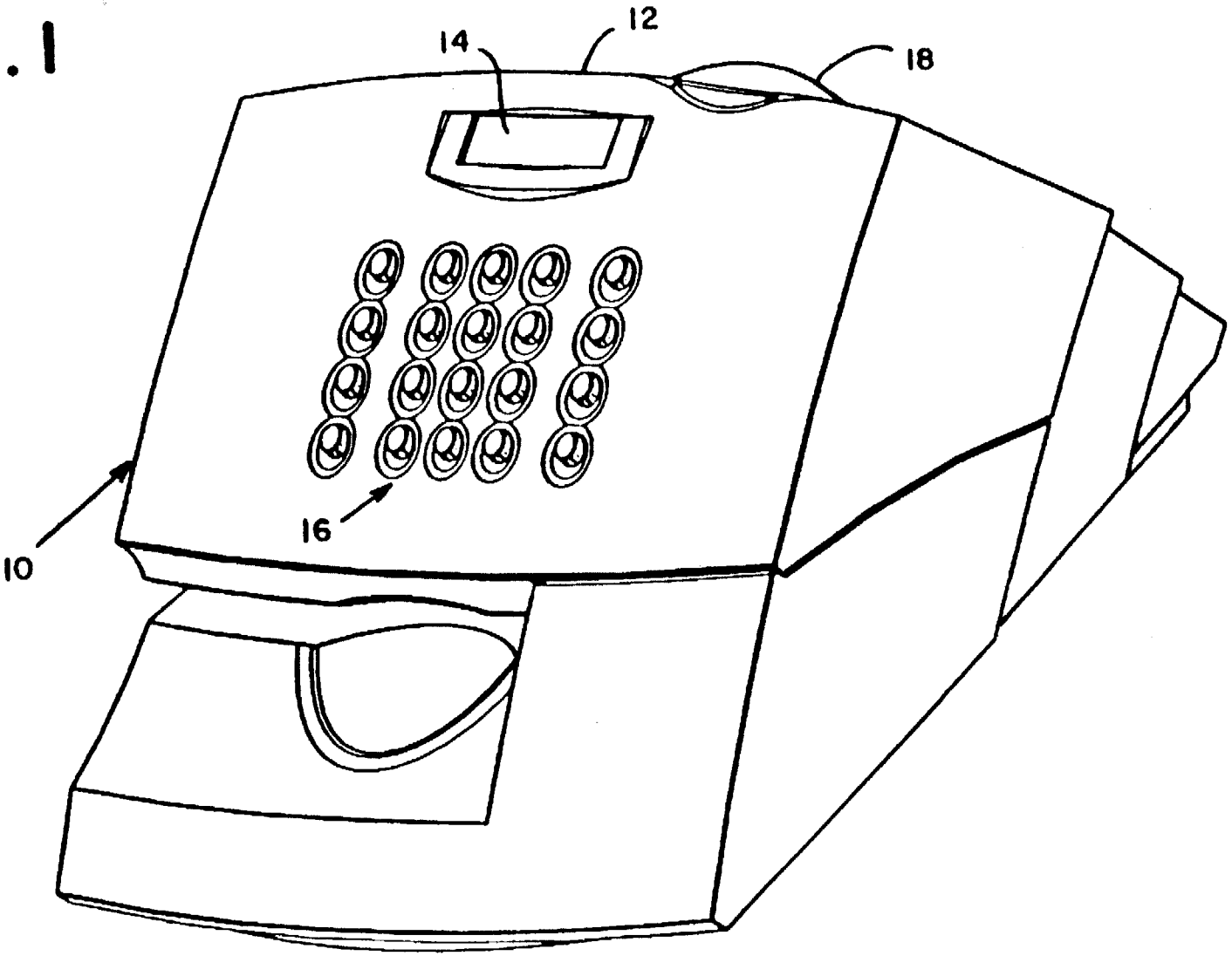
FIG. 1 is a perspective view of a multil-lingual, digital postage meter having a display screen in accordance with the instant invention.
Figure 2:
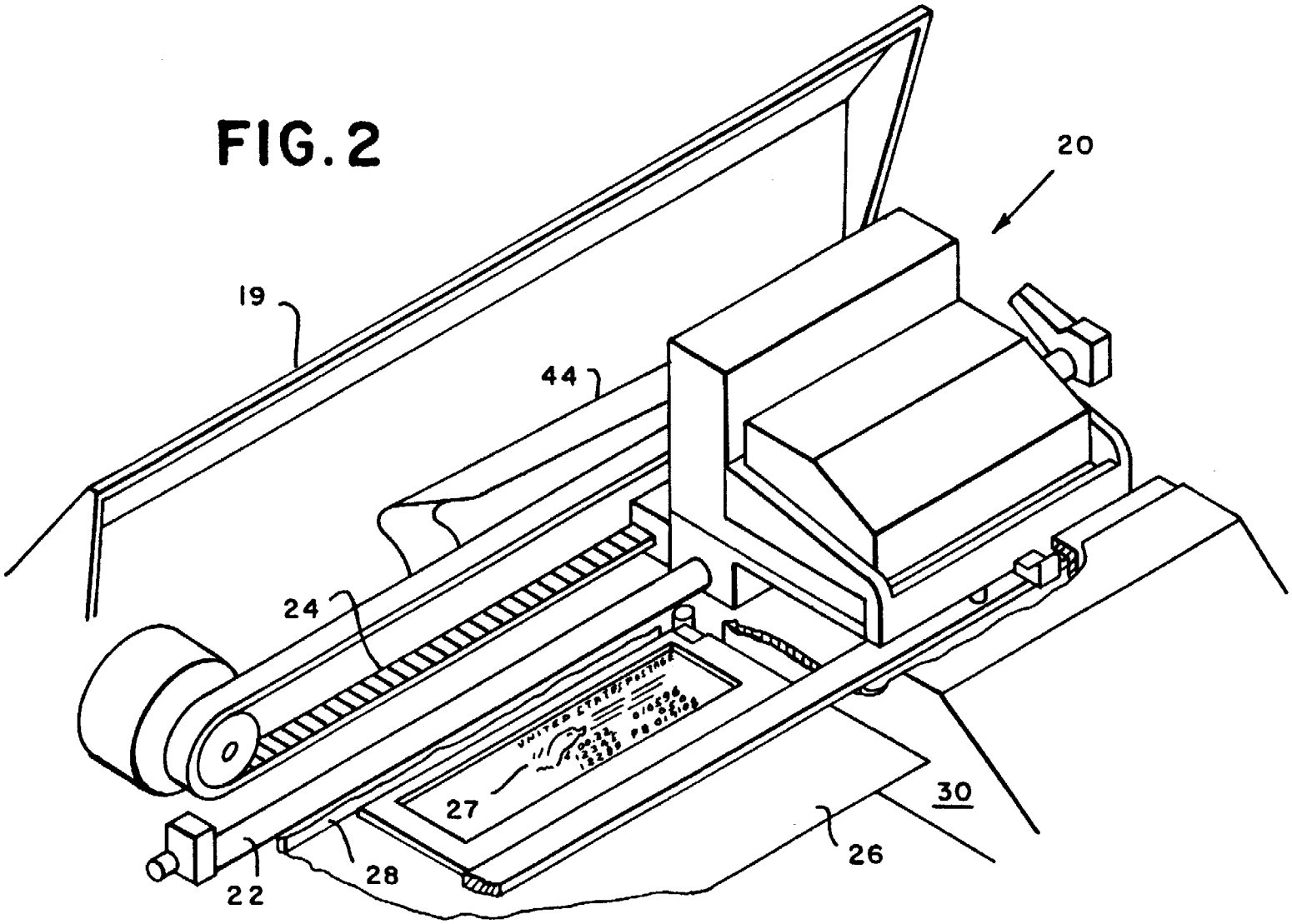
FIG. 2 is a perspective view of the interior of the meter seen in FIG. 1.

In describing the preferred embodiment of the instant invention, reference is made to the drawings, wherein there is seen in FIG. 1 a digital, multi-lingual postage meter generally designated 10 consisting of a housing shell 12, a display screen 14, a keypad 16, and a slot 18 to receive an insertable smart card (not shown). Referring now to FIG. 2, there is seen a cover 19 for the meter 10 set in a raised position revealing a removable printhead module 20 which is translatable along a shaft 22 by means of a drive belt 24. An envelope 26 which is to be digitally imprinted with an indicia 27 is registered against registration walls 28 and 30.

Figure 3:
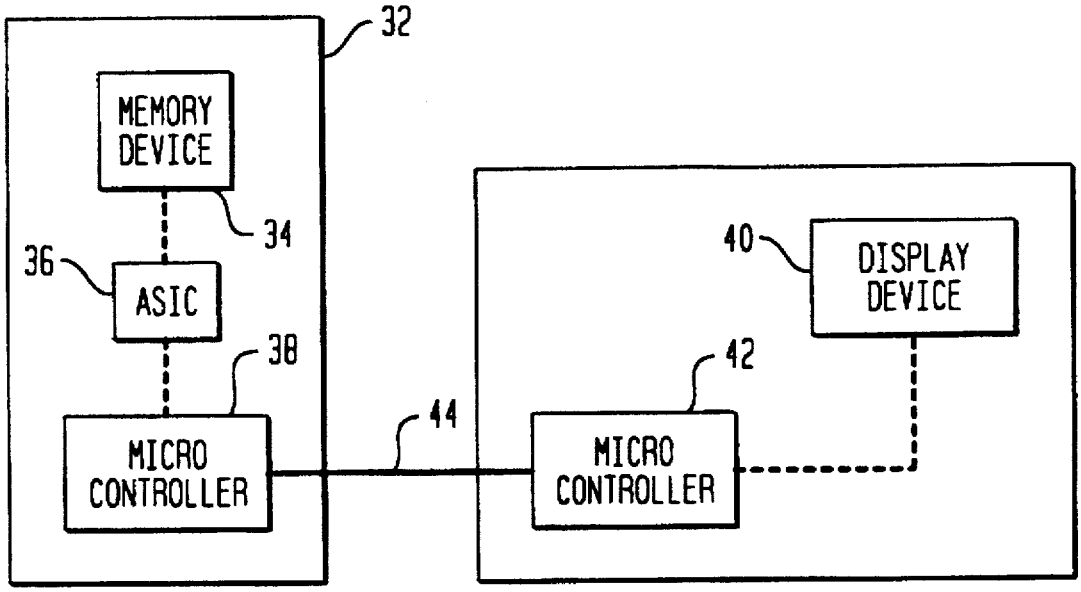
FIG. 3 is a block diagram of the modules comprising the meter seen in FIG. 1.

Referring now to FIG. 3, there is seen a printhead board 32 of the printhead module 20 which includes a memory device 34 which may be in the form of a ROM or a FLASH. An ASIC 36 is connected in parallel to the memory device 34. A first microcontroller 38 is serially connected to the ASIC 36. The meter housing shell 12 includes a screen display board 40 for the display screen 14; the board 40 is connected in parallel to a second microcontroller 42. The two microcontrollers 38 and 42 are serially connected to each other by a serial channel in the form of a ribbon cable 44.

Figure 4:
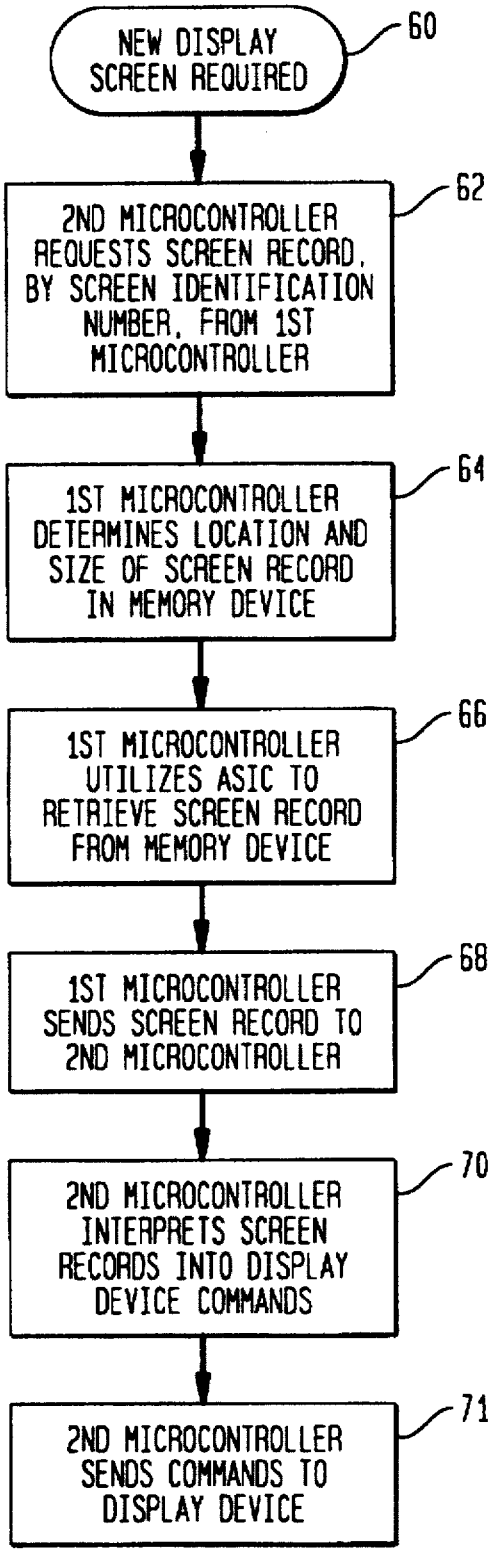
FIG. 4 is a flow chart for displaying information on the display screen of the meter seen in FIG. 1.

The operation of the multi-lingual meter 10 will now be described, referring now to FIG. 4. Whenever a new display is required on the display screen 14, which can come about because a smart card has been inserted into the slot 18 or an envelope 26 has been registered on the meter 10, or for a variety of other reasons, as indicated by block 60, the second microcontroller 42 requests a screen record, such as "Record #7" in FIG. 5 (explained in further detail hereinbelow), by a screen identification number, from the first microcontroller 38, as indicated in block 62. Then the first microcontroller 38 determines the location and size of the screen record in the memory device 34 of the printhead module 20 as indicated in block 64. The first microcontroller 38 then utilizes the ASIC 36 to retrieve the screen record from the memory device 34, as indicated in block 66. The first microcontroller 38 then sends the screen record to the second microcontroller 42, as indicated in block 68. The second microcontroller 42 then interprets the screen record into commands for the display device 40, as indicated in block 70. Finally, the second microcontroller 42 sends commands to the display device 40 resulting in a display such as the display 43 containing date information on the display screen 14, as indicated in block 71.

Reference will now be made to FIGS. 5–11 in order to discuss the content of the screen records. FIG. 5 shows "Record #7" which constitutes the encoded screen record for the date entry for an indicia for U.S. postage. The "Record #7" is stored in the print module 20. The "Interpretation" set forth below "Record #7" is conventional and well understood by those skilled in the art and thus will not be described in any further detail. FIG. 6 shows a second, linked encoded screen record, i.e. "Record #102", which is needed in addition and linked to "Record #7" because the print module 20 has limited RAM capacity for storing the screen record for transmittal; the limited RAM capacity is a result of the use of a smaller memory component in the printhead microcontroller 38 which significantly reduces cost. FIG. 7 shows the output on the display screen 14 which results from the Records #7 and #102 seen in FIGS. 5 and 6.

The "Record #7" seen in FIG. 8 is identical to "Record #7" in FIG. 5 and linked "Record #102" in FIG. 8 is identical to linked "Record #102" in FIG. 6 except that the pair of characters "2E" for date delimiting (i.e. slashes or dots) in FIG. 8 replace the pairs of characters "2F" in FIG. 6. The result of the record screens in FIG. 8 is the "Resulting United Kingdom Screen" seen in FIG. 11, which differs from the screen in FIG. 7 only by the date delimiting dots.

Similarly, the "Resulting French Screen" seen in FIG. 11 is much like the U.S. display screen seen in FIG. 7 except that letters assigning the date fields and the sequence for the date are different. Comparison of the screen records in FIGS. 5 and 6 for the U.S. display with the screen records in FIG. 9 for the French display reveal differences which result in the different screen displays seen in FIGS. 7 and 11 (French screen).

Likewise the "Resulting Japanese Screen" seen in FIG. 11 is much like the U.S. display screen seen in FIG. 7 except that word "Date" in FIG. 7 has been replaced by the Japanese equivalent in the FIG. 11 Japanese screen. Like the records in FIGS. 5 and 6 for the U.S. date entry, the records in FIGS. 8–10 are stored in the printhead module 20, which is different for each country.

The transmission of the screen records from the printhead module 20 to the second microcontroller 42, which is uniquely programmed to understand the encoded screen records, and then to the display screen 14 poses a risk of unauthorized interception. The screen records and other information necessary for transmittal purposes are transmitted over the ribbon cable 44 from the first microcontroller 38 to the second microcontroller 42 using an ISO (i.e. public) protocol. This public protocol could also be a private protocol. The second microcontroller 42 removes the other information, so that the only information remaining in the second microcontroller 42 after receiving the transmission is the screen record. The microcontroller 42 is programmed to interpret the encoded screen record and transmit the interpreted screen record to the display device 40 and associated display screen 14. The second microcontroller 42 effects the interpretation without prior knowledge of country, language, postal zone or meter model; this is because requisite display information is contained in the encoded screen record coming from the print module 20. The fact that the print module 20 contains the requisite display information provides several advantages: the meter can be used in different countries or postal zones by inserting the appropriate print module 20; future enhancements or changes to the meter 10 can be effected by simply changing the print module 20 without changing any other hardware or software in the housing shell 12. From the foregoing description, it can be understood that deciphering the messages being transmitted across the ribbon cable 44 connecting the two microcontrollers 38 and 42 would be a formidable task.

The aforesaid encoding scheme allows linked records to be used for controlling the display screen 14. Use of linked records requires less memory because smaller messages can be used. Thus, less memory is required in both microcontrollers 38 and 42 than for the case of a message having a single record containing all of the screen information for a given display operation.

Although the foregoing description related to the display of the date portion of the indicia, it should be understood that the screen display 14 shows other information, including information contained within the indicia, and similar records for such information are stored in the printhead module 20. These similar records bring about display operations, such as menus for user selection, setting of telephone numbers, postage selection, etc., in the same manner as described above.

While the present invention has been disclosed and described with reference to a single embodiment thereof, it will be apparent, as noted above that variations and modifications may be made therein. It is thus intended in the following claims to cover each variation and modification that falls within the true spirit and scope of the present invention.

What is claimed is:

1. In a digital postage meter having a housing shell, a display screen mounted in said housing shell, and a removable printhead module, a method of transmitting information from the printhead module to the display screen, comprising:

storing said information in a memory device in said printhead module;

retrieving said information in a first communication device in said printhead module;

transmitting said information from said first communication device to a second communication device external to said printhead module, wherein said second communication device interprets said information; and transmitting said interpreted information to said display screen.

2. The method of claim 1, wherein said first and second communication devices comprise a microcontroller.

3. The method of claim 2, wherein said postage meter comprises a multi-lingual postage meter.

4. The method of claim 3, wherein said printhead module includes a printhead board having a memory device containing country specific information.

5. The method of claim 4, wherein said first and second microcontrollers are serially connected to each other by a serial channel.

6. The method of claim 5, wherein said information includes records for said display screen and other information, and said display screen information is encoded.

7. The method of claim 6, wherein said transmitting said information from said first microcontroller to said second microcontroller through said serial channel is effected using a public protocol.

8. The method of claim 6, wherein said second microcontroller removes said other information and the only information remaining in said second microcontroller comprises said screen records.

9. The method of claim 8, wherein said second microcontroller interprets said encoded screen records and transmits said interpreted screen records to said display screen.

* * * * *